US012654085B2

(12) United States Patent
Zukowski

(10) Patent No.: US 12,654,085 B2
(45) Date of Patent: Jun. 16, 2026

(54) GRAPPLING APPARATUS FOR WRESTLING TRAINING

(71) Applicant: Roman Z Horse Inc., Valrico, FL (US)

(72) Inventor: Paul Zukowski, Valrico, FL (US)

( * ) Notice: Subject to any disclaimer, the term of this patent is extended or adjusted under 35 U.S.C. 154(b) by 830 days.

(21) Appl. No.: 17/998,838

(22) PCT Filed: May 17, 2021

(86) PCT No.: PCT/US2021/032716

§ 371 (c)(1),
(2) Date: Nov. 15, 2022

(87) PCT Pub. No.: WO2021/231997

PCT Pub. Date: Nov. 18, 2021

(65) Prior Publication Data

US 2023/0201687 A1 Jun. 29, 2023

Related U.S. Application Data

(60) Provisional application No. 63/025,342, filed on May 15, 2020.

(51) Int. Cl.

| | |
|---|---|
| ***A63B 69/34*** | (2006.01) |
| ***A63B 1/00*** | (2006.01) |
| ***A63B 69/22*** | (2006.01) |

(52) U.S. Cl.

CPC ..... *A63B 69/34* (2013.01); *A63B 1/00* (2013.01); *A63B 69/222* (2022.08); (Continued)

(58) Field of Classification Search

CPC ..... A63B 69/34; A63B 1/00; A63B 69/222; A63B 2214/00; A63B 2244/102; A63B 2244/108

(Continued)

(56) References Cited

U.S. PATENT DOCUMENTS 1,744,594 A * 1/1930 Trzesniewski ..... A63B 9/00 472/126
5,503,606 A * 4/1996 Stephens ..... A63B 69/22 482/7

(Continued)

FOREIGN PATENT DOCUMENTS

CN 103331015 A * 10/2013
CN 206896660 U * 1/2018

(Continued)

*Primary Examiner* — Dmitry Suhol
*Assistant Examiner* — Julie Grace Dosher
(74) *Attorney, Agent, or Firm* — Rivkin Radler LLP

(57) ABSTRACT

The present disclosure provides grappling apparatus (100) for training a person (P) for wrestling. The grappling apparatus (100) includes multiple support members (102) for supporting the grappling apparatus (100) on a floor (F). The grappling apparatus (100) also includes at least one horizontal bar (108) having a length of about 1.5 meters to about 2.5 meters and configured to couple with the support members (102). The horizontal bar (108) is located at a height (H) of about 45 centimeters to about 70 centimeters from the floor (F), extends between two support members (102), and configured to allow the person (P) to grasp the horizontal bar (108) with hands, body, and legs.

4 Claims, 10 Drawing Sheets

(52) U.S. Cl.
CPC ..... *A63B 2214/00* (2020.08); *A63B 2244/102* (2013.01); *A63B 2244/108* (2013.01)

(58) Field of Classification Search
USPC ..... 434/247, 258
See application file for complete search history.

(56) References Cited

U.S. PATENT DOCUMENTS

| | | | | | |
|---|---|---|---|---|---|
| 5,722,920 | A * | 3/1998 | Bauer | A63B 69/22 | 482/90 |
| 5,803,875 | A * | 9/1998 | Colace | A63B 69/20 | 473/520 |
| 2004/0053754 | A1* | 3/2004 | Tatton | A63B 21/055 | 482/83 |
| 2007/0010375 | A1* | 1/2007 | Corte | A63B 1/00 | 482/41 |
| 2014/0235374 | A1* | 8/2014 | Armell | A63B 69/0097 | 473/434 |
| 2023/0068254 | A1* | 3/2023 | Weinast | A63B 5/11 | |

FOREIGN PATENT DOCUMENTS

| | | | | |
|---|---|---|---|---|
| CN | 207928611 U | * | 10/2018 | |
| ES | 2588949 A1 | * | 11/2016 | A63B 7/045 |

* cited by examiner

GRAPPLING APPARATUS FOR WRESTLING TRAINING

TECHNICAL FIELD

The present disclosure relates to athletic training apparatus and more specifically relates to grappling apparatus for training a person for wrestling.

BACKGROUND

Physical activities, such as wrestling, gymnastics, powerlifting, combat training in military, and the like require high levels of fitness and physical strength. Among all such physical activities, different forms of martial arts, gymnastics, hand to hand military combat, and wrestling requires grappling, grasping, and gripping strength. In the classical sport of wrestling, two participants compete with one another in which each of the two participants attempt to achieve physical dominance over the other. The training regime for wrestling may include practicing various wrestling maneuvers and techniques with a training partner, who may be another wrestler or a coach. However, a drawback of such practice with a training partner is the need to work in real time with another competent person. Often, it may be difficult to find suitable training partner to execute the training regime for a desired time period, thereby limiting the training time for the wrestling student. Even in the case of training sessions with the suitable partner, the wrestler may suffer injuries, which is not desired.

Therefore, there exists a need for a wrestling training system or device that helps individuals to train for wrestling without the need for another competent person, and with a greater degree of safety, and avoiding injury.

SUMMARY

According to one aspect of the present disclosure, a grappling apparatus for wrestling training is disclosed. The grappling apparatus includes a plurality of support members having a leg for supporting the grappling apparatus on a floor and at least one horizontal bar having a length of about 1.5 meters to about 2.5 meters. The horizontal bar is configured to couple with the plurality of support members and is located at a height of about 45 centimeters to about 70 centimeters from the floor. In an embodiment, a diameter of the horizontal bar is in a range of about 8 centimeters to about 12.5 centimeters. Further, the horizontal bar extends between two support members and is configured to allow a person to grasp the horizontal bar with hands, body, and legs.

In an embodiment, the grappling apparatus further includes a plurality of foot members. Each foot member is configured (i) to couple with one support member of the plurality of support members, and (ii) to stably retain the grappling apparatus on the floor.

In an embodiment, the grappling apparatus further includes a plurality of coupling members. Each coupling member is configured to couple the horizontal bar with the support member. In an embodiment, each of the coupling member, the at least one horizontal bar, and the support member is made of one of synthetic polymer or steel.

In an embodiment, the grappling apparatus further includes cushioning material wrapped around on the horizontal bar, and one or more punching bags suspended from the horizontal bar. In an embodiment, the grappling apparatus further includes at least one circular connecting tube, where at least two horizontal bars are positioned at right angles to each other and intersecting at mid-points thereof to define a cross. The at least one circular connecting tube connects ends of the at least two horizontal bars, and each support member extends from one end of each horizontal bar.

In an embodiment, the grappling apparatus includes three horizontal bars are connected to each other at ends thereof to define a triangle, and each support member extends from a vertex of the triangle. In an embodiment, the grappling apparatus includes four horizontal bars are connected in an order to define a quadrilateral, and each support member extends from a vertex of the quadrilateral.

According to another aspect of the present disclosure, a grappling apparatus for training a person for wrestling is disclosed. The grappling apparatus includes a bar comprising a first end and a second end, and a length of about 1.5 meters to about 2.5 meters. The grappling apparatus further includes a first vertical supporting member coupled to the first end of the bar and a second vertical supporting member coupled to the second end of the bar. A length of the second vertical supporting member is greater than a length of the first vertical supporting member, such that the first end of the bar is proximal to a floor and the second end of the bar is distal from the floor. The first end of the bar is located at a height of about 20 centimeters to about 40 meters from the floor and the second end of the bar is located at a height of about 45 centimeters to about 70 centimeters from the floor. The bar is configured to allow the person to grasp the horizontal bar with hands, body, and legs.

According to yet another aspect of the present disclosure, a method of training a person for wrestling is disclosed. The method includes grasping at least one horizontal bar of a grasping apparatus, the horizontal bar configured to allow the person to grasp the horizontal bar with the hands, body, and legs. The horizontal bar includes a length in a range of about 150 centimeters to about 250 centimeters and a diameter of about 8 centimeters. The horizontal bar is disposed at a height of about 45 centimeters to about 65 centimeters from a floor. The method also includes performing one or more exercises while maintaining contact with the horizontal bar. In some embodiments, the method further includes rotating the body around the horizontal bar while grasping the horizontal bar with hands and legs. In some embodiments, the method further includes suspending the upper body on the floor, grasping the horizontal bar with legs, and punching sandbags disposed on the horizontal bar.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims.

As used herein, the terms "a", "an" and the like generally carry a meaning of "one or more," unless stated otherwise. Further, the terms "approximately", "approximate", "about", and similar terms generally refer to ranges that include the identified value within a margin of 20%, 10%, or preferably 5%, and any values therebetween.

Aspects of the present disclosure are directed to a grappling apparatus for training a person for wrestling. The grappling apparatus is capable of providing a full body workout to the person using the grappling apparatus, where gravity serves as an adversary force during the wrestling training.

Figure 1A:
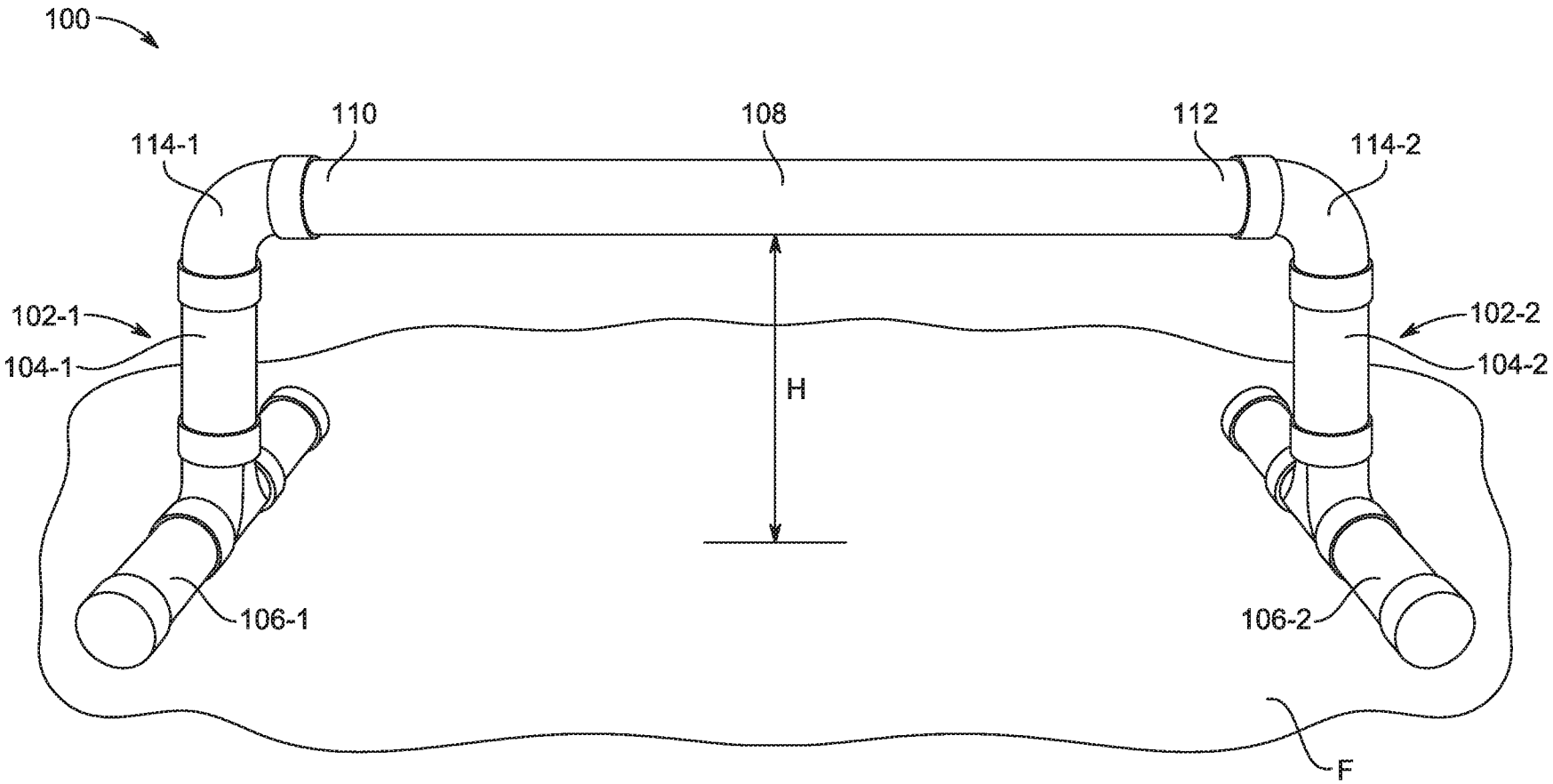
FIG. 1A is a perspective view of a grappling apparatus, according to an embodiment of the present disclosure.
Figure 1B:
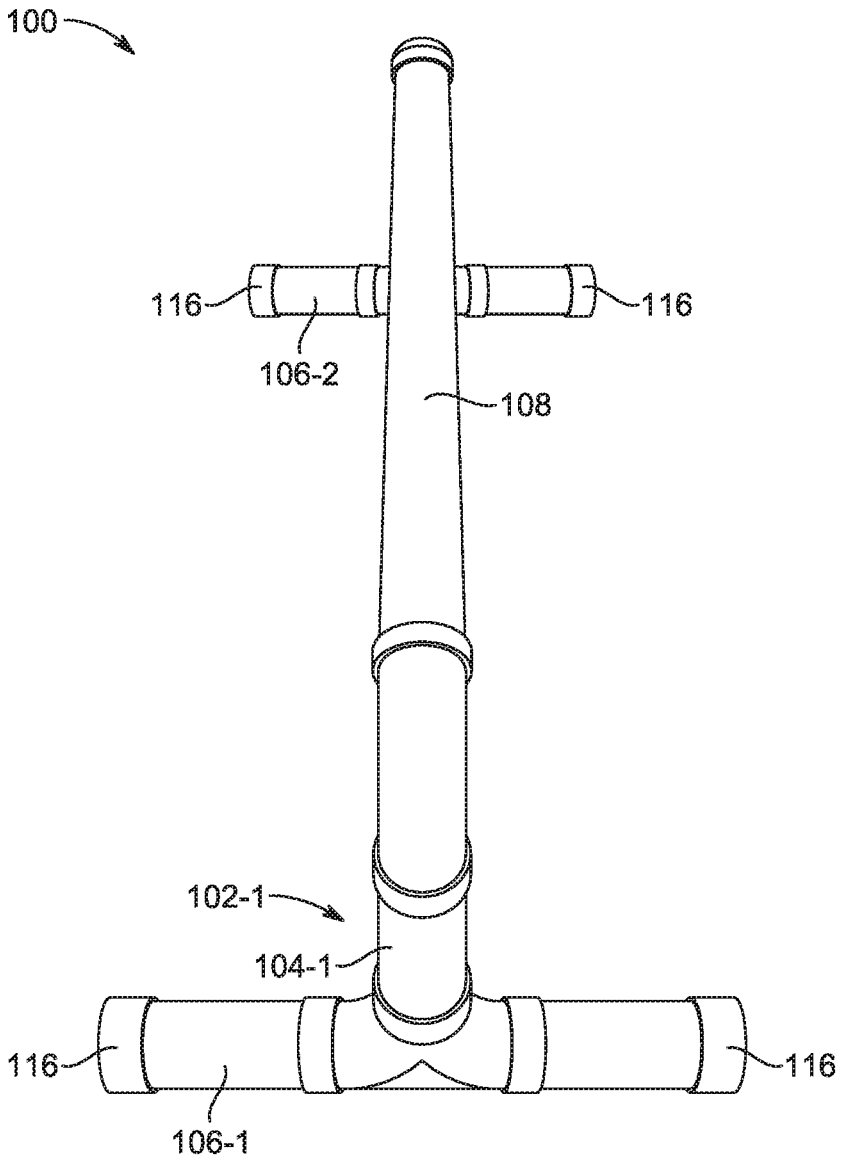
FIG. 1B is another perspective view of the grappling apparatus, according to an embodiment of the present disclosure.

Referring to FIGS. 1A and 1B, perspective views of the grappling apparatus 100 are illustrated. As used herein, the term "grappling" refers to an act of firmly holding the apparatus 100 and bar 108 while training for physical activities, particularly wrestling. The apparatus may be held with the hands, arms, body, legs, and feet in contact with bar 100 or legs 102, or with any two contact points selected from hands, arms, body, legs, and feet. In an embodiment, the grappling apparatus 100 includes multiple legs 102, where each leg includes a vertical support member 104, a foot member 106, and a coupling member 114. The legs 102 extending perpendicularly from a floor "F" and configured to support the grappling apparatus 100 on the floor "F". The grappling apparatus 100 further includes multiple foot members 106, where each foot member is configured to couple with one leg and stably retain the grappling apparatus 100 on the floor "F". For example, a first leg 102-1 includes a first vertical support member 104-1 and a first foot member 106-1 coupled to the first vertical support member 104-1, and a second leg 102-2 includes a second vertical support member 104-2 and a second foot member 106-2 coupled to the second leg 104-2.

The grappling apparatus 100 also includes at least one horizontal bar, such as the horizontal bar 108, having a first end 110 and a second end 112. The horizontal bar 108 is configured to couple with the legs 102, where the horizontal bar 108 extends between two legs 102. As seen in FIG. 1, the horizontal bar 108 extends between the first leg 102-1 and the second leg 102-2. In an embodiment, the grappling apparatus 100 also includes multiple coupling members 114, where each coupling member is configured to couple the horizontal bar 108 with a leg 102. For example, a first coupling member 114-1 is configured to couple the first end 110 of the horizontal bar 108 with the first leg 102-1 and a second coupling member 114-2 is configured to couple the second end 112 of the horizontal bar 108 with the second leg 102-2. In an example, each coupling member 114 may be embodied as a Tee connector, an inclined connector, an elbow connector, or a straight connector. In an embodiment, each of the coupling members 114, the horizontal bar 108, and the legs 102 is made of one of synthetic polymer or steel.

In an embodiment, the horizontal bar 108 has a length in a range of about 1.5 meters to about 2.5 meters (about 6 to 8 feet long) and a diameter in a range of about 8 centimeters to about 12.5 centimeters. This diameter encompasses 4 in. diameter piping. In addition, the horizontal bar 108 is located at a height "H" of about 45 centimeters to about 70 centimeters from the floor "F". The height "H" may be measured between the floor "F" and a center line of the horizontal bar 108 that is proximal to the floor "F". In an embodiment, the horizontal bar is 2 feet (61 cm) above the floor "F".

In an embodiment, each of the horizontal bar 108, the legs 102, and the coupling members 114 is made from polyvinyl chloride (PVC) pipe used in plumbing, for example 4 inch PVC piping. As such, the grappling apparatus 100 may be built with readily available materials and at minimum cost. In some embodiments, each of the horizontal bar 108, the legs 102, and the coupling members 114 is made from acrylonitrile butadiene styrene (ABS), chlorinated polyvinyl chloride (CPVC), high-density polyethylene (HDPE), polybutylene (PB-1), polyethylene (PE), polyethylene of raised temperature (PE-RT), polypropylene (PP), polyvinylidene difluoride (PVDF), unplasticized polyvinyl chloride (uPVC), or combinations thereof. The first end 110 and the second end 112 of the horizontal bar 108 may be glued or fastened to the coupling members 114 to reinforce the coupling between the horizontal bar 108 and the legs 102. In an embodiment, the grappling apparatus 100 may include cushioning material (not shown) wrapped around the horizontal bar 108 to provide comfort to a person "P" (see FIG. 2A) grasping the horizontal bar 108. In an example, the cushioning material may be ethylene-vinyl acetate (EVA) copolymer sponge padding, neoprene, ethylene propylene diene terpolymer (EPDM), styrene-butadiene rubber (SBR), polyurethane, nitrile butadiene rubber (NBR), silicone, cross-linked polyethylene (XLPE), industrial polyurethanes, or combinations thereof. In another example, the cushioning material may be made from polystyrene (PS), polyurethane (PU), or polyethylene (PE). In an embodiment, the apparatus may be constructed from other materials, such as steel piping, carbon fiber tubing, or wood.

FIG. 1B illustrates another perspective view of the grappling apparatus 100. In an embodiment, end caps 116 are coupled to ends of each foot member 106. Further, in some embodiments, each foot member 106 may be selectively rotated about an axis of respective leg 102, such that the foot member 106 may be aligned parallel to the horizontal bar 108. Such configuration allows easy positioning of the grappling apparatus 100 against a wall (not shown) and may consume minimum space for storing the grappling apparatus 100.

Figure 2A:
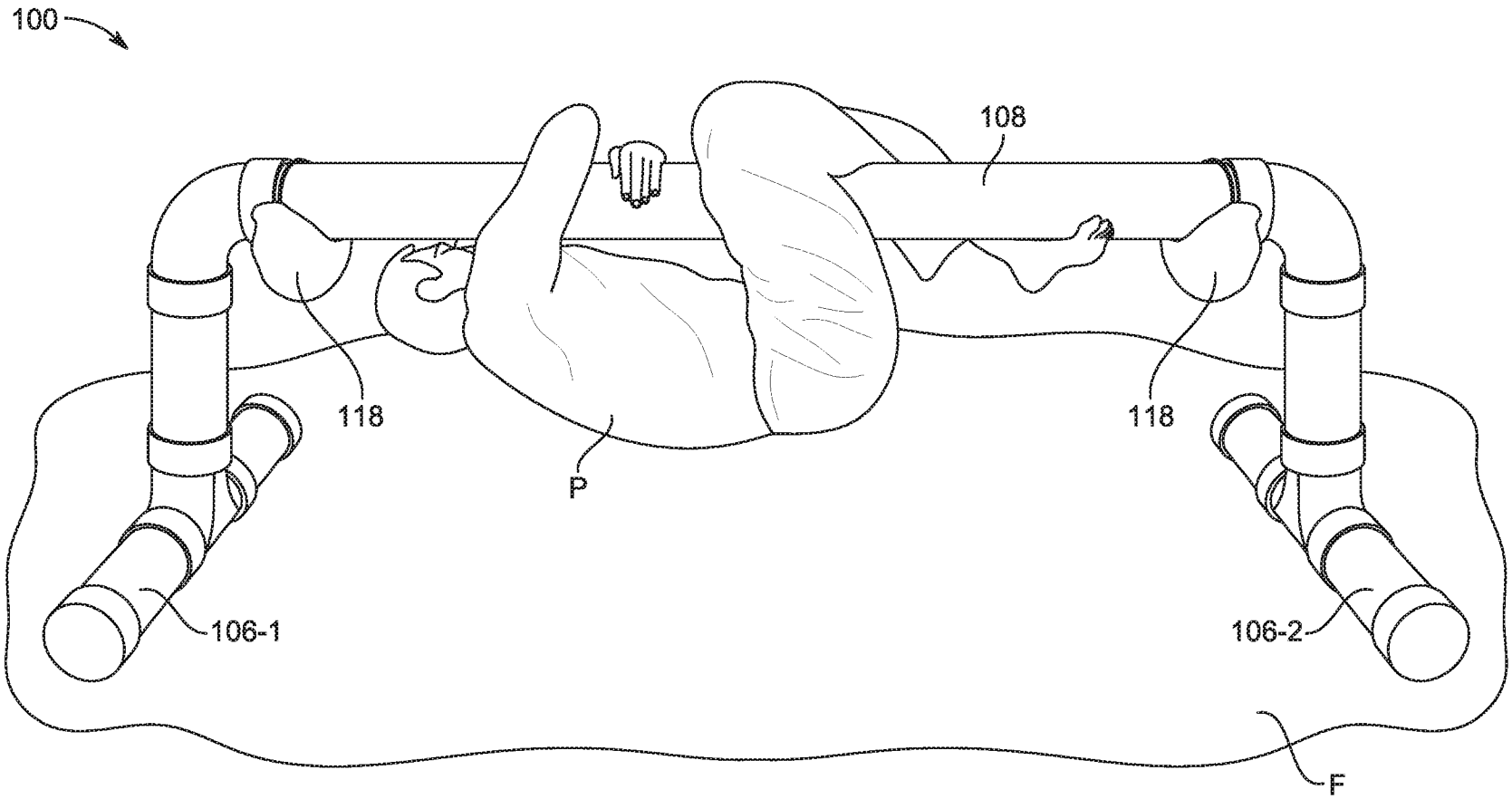
FIG. 2A shows a person in a first position grasping the grappling apparatus.
Figure 2B:
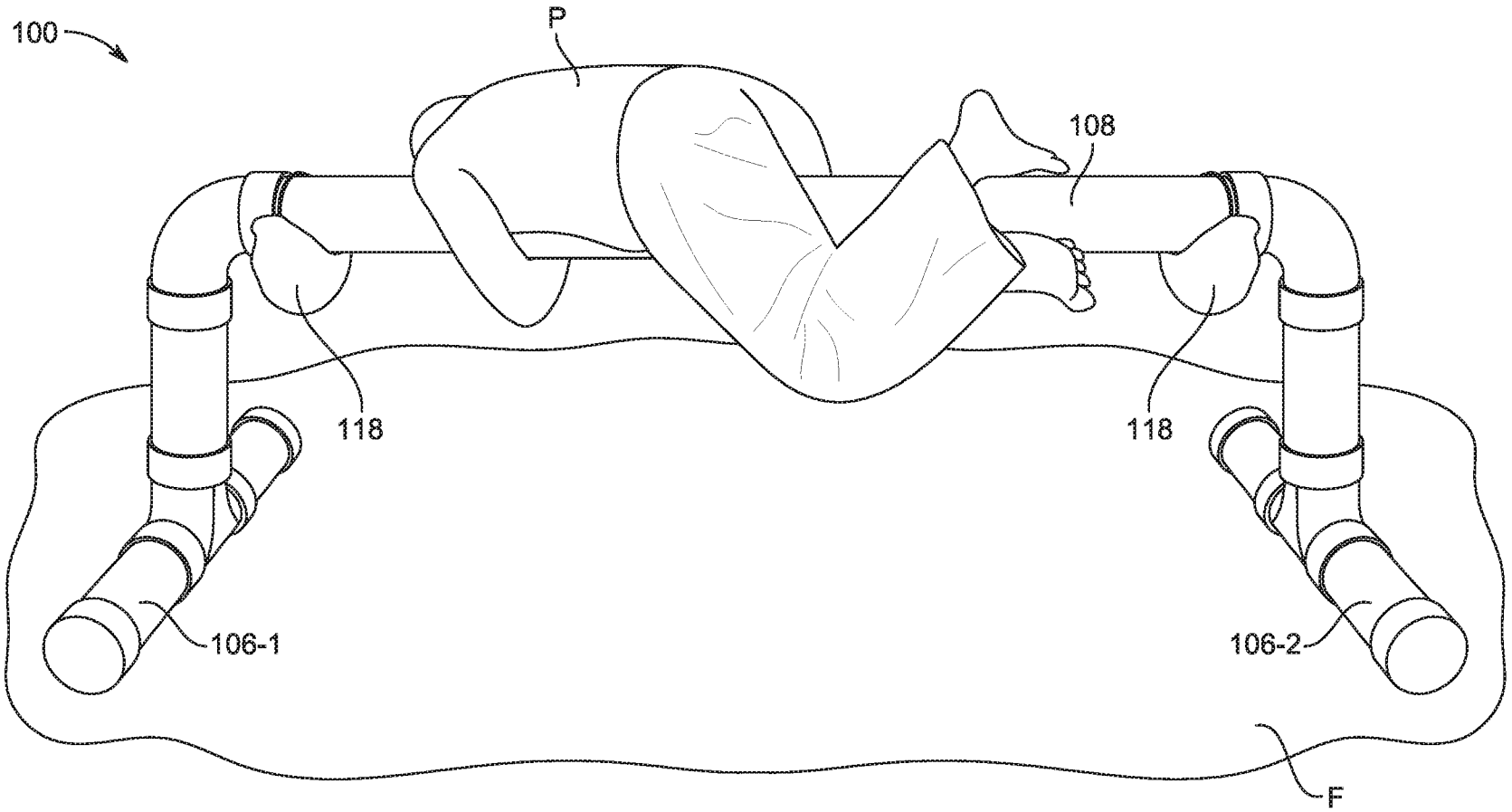
FIG. 2B shows the person in a second position grasping the grappling apparatus.

FIG. 2A illustrates a person "P" in a first position grasping the grappling apparatus 100 from underneath with their hands, arms, legs, and feet. FIG. 2B illustrates the person "P" in a second position grasping the grappling apparatus 100 with their hands, arms, body, legs, and feet. As described earlier, the diameter of the horizontal bar 108 is in a range of about 8 centimeters to about 12.5 centimeters and the horizontal bar 108 is located at the height "H" of about 45 centimeters to about 70 centimeters from the floor "F". With such configuration, the horizontal bar 108 is configured to allow the person "P" to grasp the horizontal bar 108 with their hands, arms, and legs as shown in FIG. 2A. As such, the person "P" may easily grasp the horizontal bar 108 with his arm, suspend his body (referred to as the "first position") from the horizontal bar 108, and perform multiple exercises in the suspended position as a part of the wrestling training. The term "grasp" refers to an act of firmly embracing the horizontal bar 108 with at least one of hands and legs to remain suspended from the horizontal bar 108 or suspended on the horizontal bar 108, as shown in FIG. 2A and FIG. 2B respectively. For example, the person "P" may hold the horizontal bar 108 with his fingers and may lock his arms around the horizontal bar 108. Similarly, the person "P" may hold the horizontal bar 108 with his feet or may lock the legs around the horizontal bar 108. Such acts may be considered as "grasping" in the present disclosure. The exercises may include, for example, but not limited to, grasping the horizontal bar 108 with legs and arms, performing lunges with the body and one hand while grasping the horizontal bar 108 with body and legs, raising and lowering the body with respect to the horizontal bar 108, rotating the body around the horizontal bar 108 latitudinally, moving the body from below the horizontal bar 108 to a position above the horizontal bar 108 (referred to as the "second position", as shown in FIG. 2B), suspending the body on the horizontal bar 108 while grasping the horizontal bar 108 with body, hand, and legs, balancing the body on the horizontal bar 108 by distributing force between the legs and arms, and holding the horizontal bar 108 with legs crossed (as shown in FIG. 2A) or clasping the legs on the horizontal bar 108. Such exercises with the grappling apparatus 100 help the person "P" to increase core strength, plan for counter-attack moves, and train for wrestling in absence of an actual opponent. The foot members 106 are configured to stably retain the grappling apparatus 100 in position when the person "P" suspends himself from the horizontal bar 108.

Figure 2C:
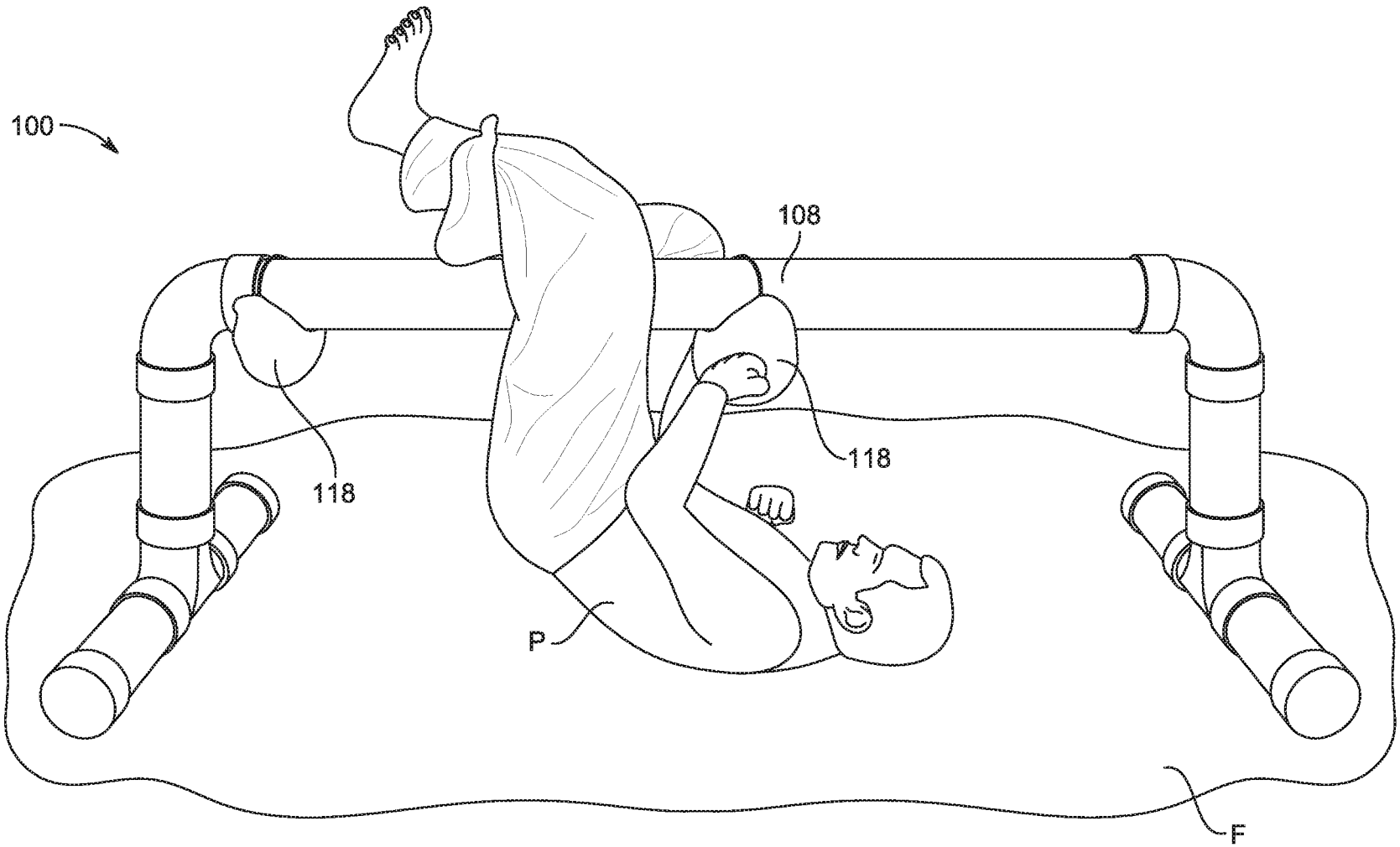
FIG. 2C shows the person in a third position grasping the grappling apparatus.

Referring to FIG. 2C, in an embodiment, the grappling apparatus 100 includes one or more punching bags 118 (also shown in FIG. 2A and FIG. 2B) suspended from the horizontal bar 108. The punching bags 118 may be filled with sand or ball bearings and may be slid along the length of the horizontal bar 108 to a desired position. The person "P" may grasp the horizontal bar 108 with crossed legs and rest his back on the floor "F". In such a position, the person "P" may practice punching exercises and train himself for other physical activities, such as boxing, taekwondo, on the punching bags 118. Such distance between the horizontal bar 108 and the floor "F" eliminates possibility of any injury to the person "P" in case the person "P" loses grip and falls on the floor "F". In addition, grasping the horizontal bar 108 with the legs and resting the upper portion of the body may help the person "P" to gain more grasping strength and endure for longer durations in such position.

Figure 3:
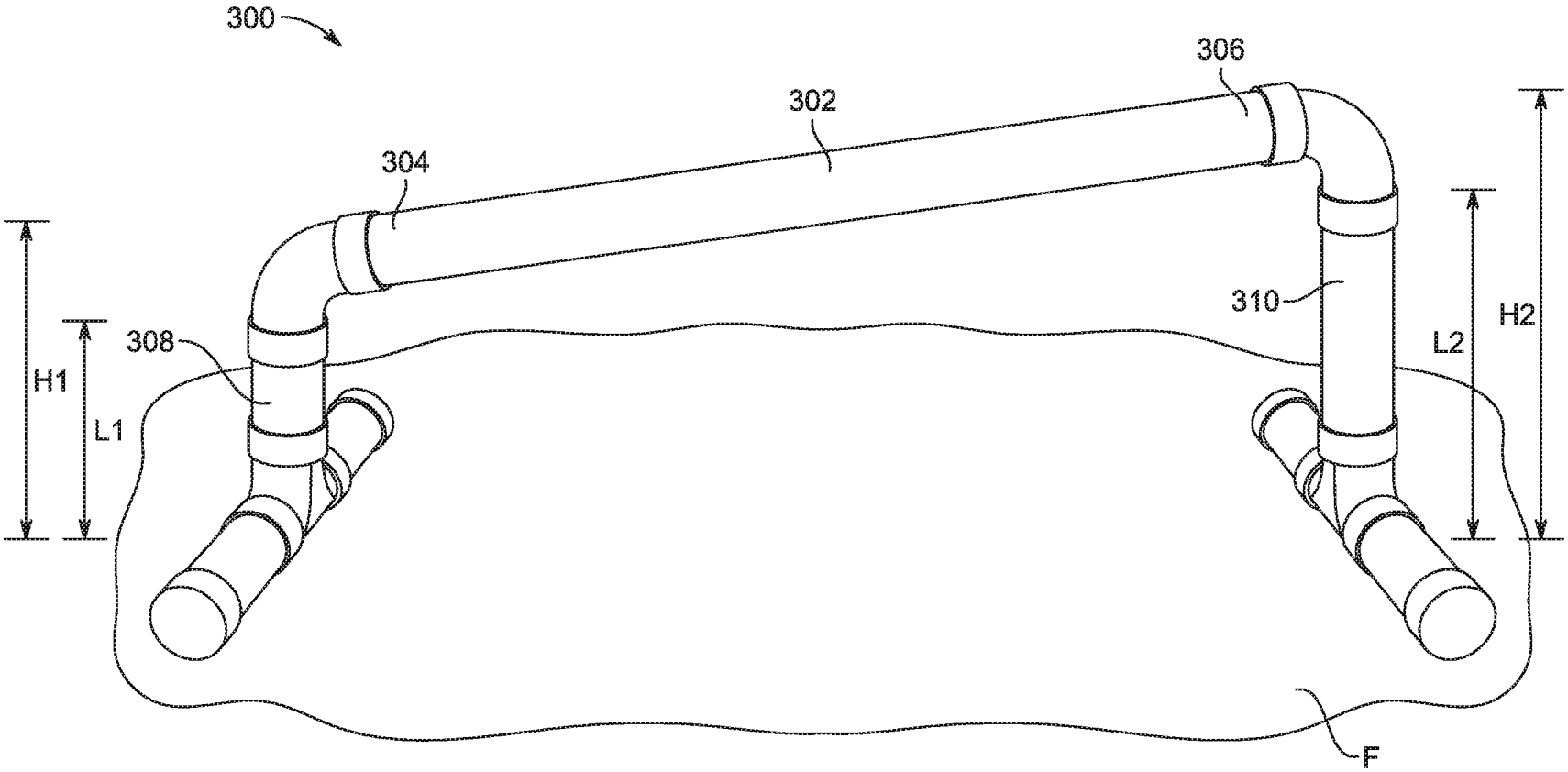
FIG. 3 is a perspective view of a grappling apparatus, according to another embodiment of the present disclosure.

FIG. 3 illustrates another embodiment of the grappling apparatus 300. In this embodiment, the grappling apparatus 300 includes a bar 302 having a first end 304, a second end 306, and a length of about 1.5 meters to about 2.5 meters defined between the first end 304 and the second end 306. The grappling apparatus 300 also includes a first vertical supporting member 308 coupled to the first end 304 of the bar 302 and a second vertical supporting member 310 coupled to the second end 306 of the bar 302. A length "L2" of the second vertical supporting member 310 is greater than a length "L1" of the first vertical supporting member 308, such that the first end 304 of the bar 302 is proximal to the floor "F" and the second end 306 of the bar 302 is distal from the floor "F". Particularly, the first end 304 of the bar 302 is located at a height "H1" in a range of about 20 centimeters to about 40 centimeters from the floor "F" and the second end 306 of the bar 302 is located at a height "H2" in a range of about 45 centimeters to about 70 centimeters from the floor "F". As such, the bar 302 is inclined with respect to the floor "F" and is configured to allow the person "P" to grasp the bar 302 with their hands, arms, body, legs, and feet.

Figure 4:
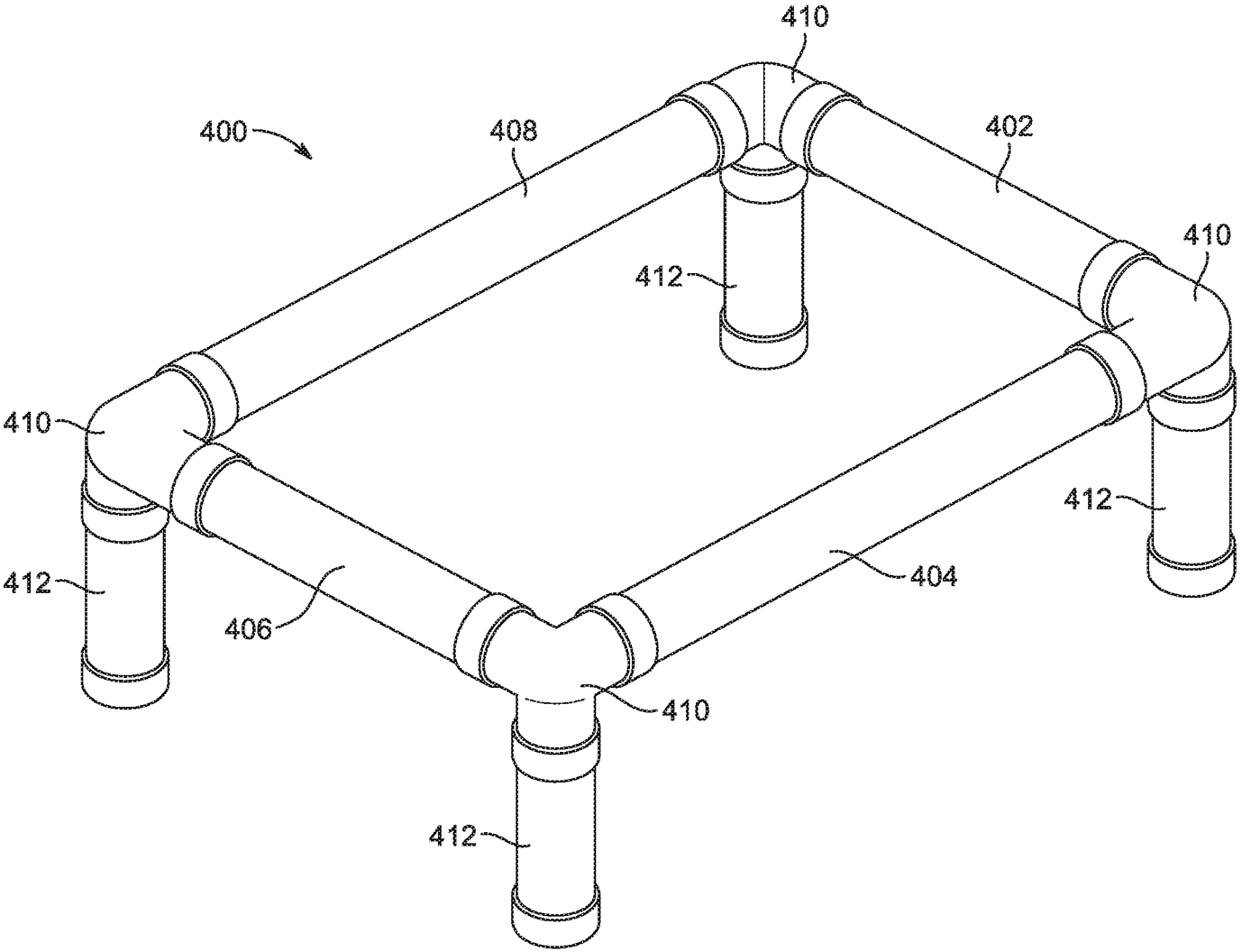
FIG. 4 is a perspective view of a grappling apparatus, according to an embodiment of the present disclosure.

FIG. 4 illustrates a grappling apparatus 400. In an embodiment, the grappling apparatus 400 includes four horizontal bars, such as a first horizontal bar 402, a second horizontal bar 404, a third horizontal bar 406, and a fourth horizontal bar 408, are connected in an order, with aid of coupling members, such as three-way connectors 410, to define a quadrilateral as shown in FIG. 4. Vertical support members 412 are connected to each three-way connector 410 and extends from respective vertices of the quadrilateral. Although the configuration illustrated in FIG. 4 represents a rectangle, it will be understood that a square configuration or a trapezoidal configuration may be achieved by varying the lengths of the horizontal bars accordingly. In some embodiments, the length of one of the four support members may be reduced, thereby having two bars among the four horizontal bars inclined at a predetermined angle with respect to the floor "F" (similar to the configuration described with respect to FIG. 3).

Figure 5:
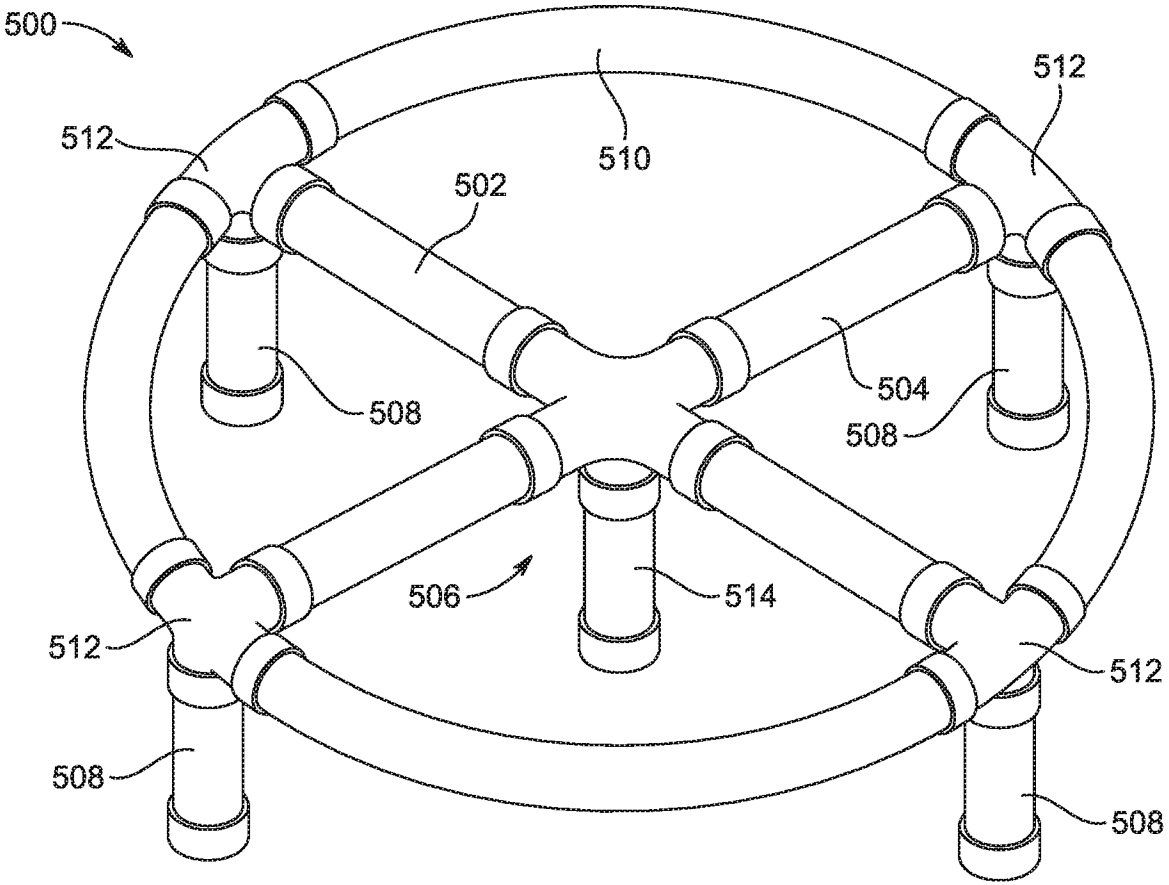
FIG. 5 is a perspective view of a grappling apparatus, according to an embodiment of the present disclosure.

FIG. 5 illustrates a grappling apparatus 500. In an embodiment, the grappling apparatus 500 includes a first horizontal bar 502 and a second horizontal bar 504 positioned at right angles to each other, such that the first horizontal bar 502 and the second horizontal bar 504 intersect at mid-points thereof to define a cross 506. The grappling apparatus 500 further includes multiple support members 508 and a circular connecting tube 510 connecting ends of the first horizontal bar 502 and the second horizontal bar 504. Each support member 508 extends from one end of each horizontal bar. In an embodiment, four-way connectors 512 are used to couple the ends of the horizontal bar 502, 504 with the support member 508, and the circular connecting tube 510 passes through the four-way connectors 512. A central support member 514 may also be provided to prevent the grappling apparatus 500 from sagging at the center thereof while the person "P" performs the exercises. In some embodiments, the first horizontal bar 502 and the second horizontal bar 504 may intersect at any point other than the mid-points thereof and may be positioned at any angle defined therebetween. In some embodiments, the grappling apparatus 500 may include three or more horizontal bars.

Figure 6:
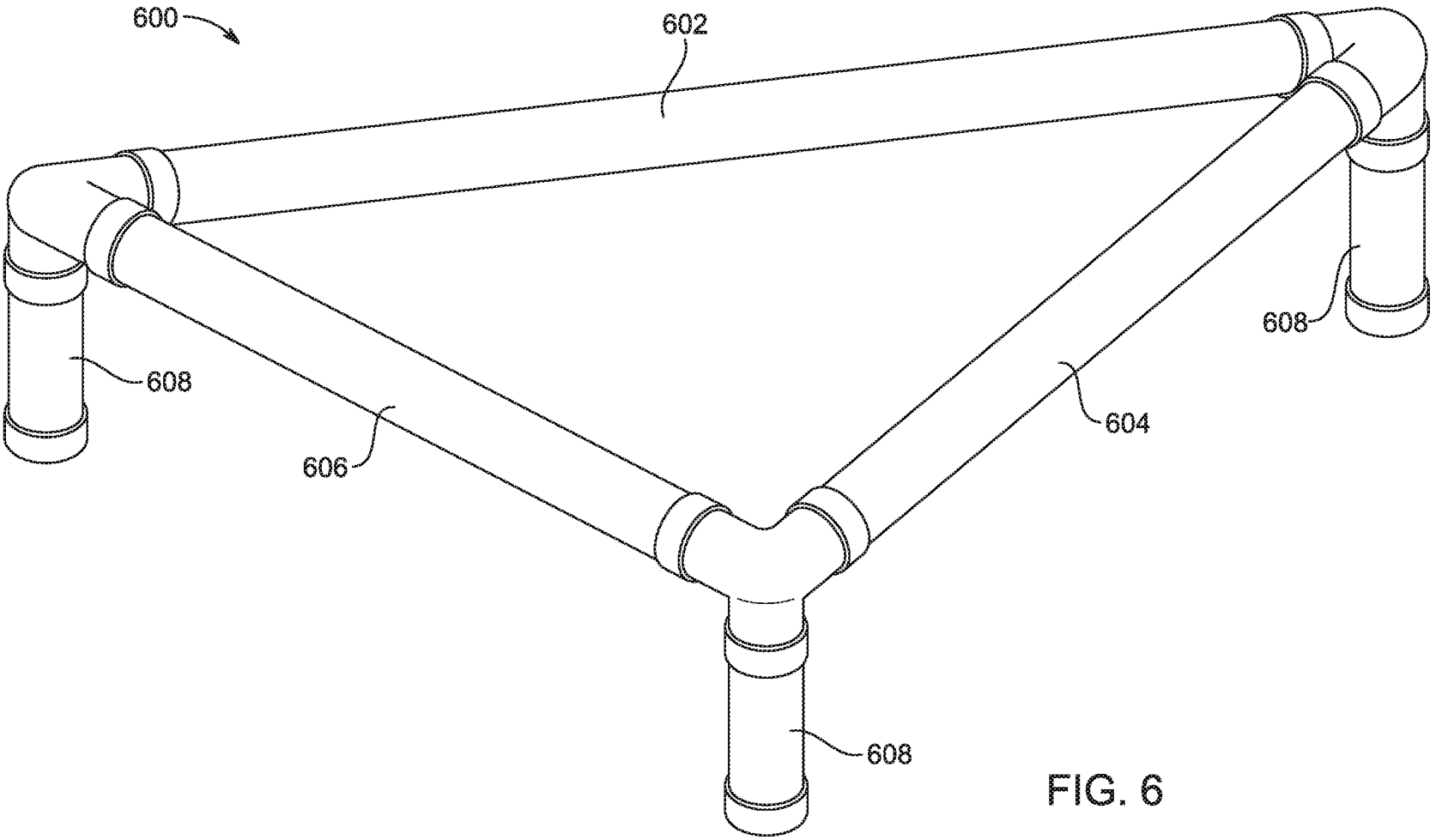
FIG. 6 is a perspective view of a grappling apparatus, according to an embodiment of the present disclosure.

FIG. 6 illustrates a grappling apparatus 600. In an embodiment, the grappling apparatus 600 includes three horizontal bars, such as a first horizontal bar 602, a second horizontal bar 604, and a third horizontal bar 606, are connected to each other at ends thereof to define a triangle. The grappling apparatus 600 also includes multiple support members 608, where each support member 608 extends from a vertex of the triangle. In some embodiments, the length of one support member 608 may be reduced, for example halved, as compared to the other two support members 608. In such arrangement, the grappling apparatus 600 may include two bars which are inclined with respect to the floor "F" while a third bar remains parallel to the floor "F". In some embodiments, one of the bars of the grappling apparatus 600 may be arcuate while the other two bars are horizontal. It will be understood that appropriate coupling members may be used to arrive at such configurations.

Figure 7:
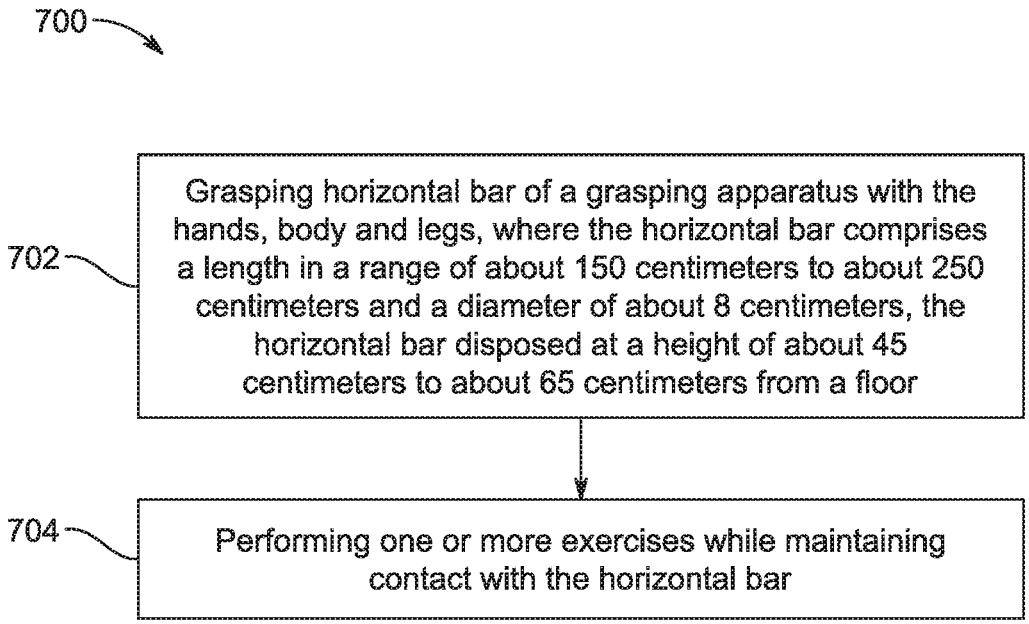
FIG. 7 is flowchart of a method for training the person for wrestling, according to an embodiment of the present disclosure.

FIG. 7 illustrates a flowchart of a method 700 for training the person "P" for wrestling. The method 700 is described in conjunction with FIG. 1A through FIG. 2B. At step 702, The method 700 includes grasping the horizontal bar 108 of the grappling apparatus 100 with the hands, body, and legs. In an embodiment, the method 700 at step 702, includes firmly holding the horizontal bar 108 with the hands. In an embodiment, the method 700 at step 702 includes locking the arm (as shown in FIG. 2A and FIG. 2B) around the horizontal bar 108. In an embodiment, the method 700 includes grasping the horizontal bar 108 with legs (as shown in FIG. 2C), so that the upper portion of the body can be rested on the floor "F". Such grasping helps to increase physical strength, stamina, and endurance in the upper portion and lower portion of the body. In an embodiment, the method 700 includes grasping the horizontal bar 108 with the hands and the body, where feet can be rested on floor "F". Such combination of hands and body in grasping activity helps in gaining strength and endurance to the upper portion of the body since the person "P" is exercising against gravity. The length of the horizontal bar 108 is in a range of about 150 centimeters to about 250 centimeters and the diameter is about 8 centimeters. The horizontal bar 108 is disposed at the height "H" of about 45 centimeters to about 65 centimeters from the floor "F".

At step 704, the method 700 includes performing one or more exercises while maintaining contact with the horizontal bar 108. Although not explicitly shown in FIG. 7, in some embodiments, the method 700 further includes rotating the body around the horizontal bar 108 while grasping the horizontal bar 108 with hands and legs. In some embodiments, the method 700 further includes suspending the upper body on the floor "F", grasping the horizontal bar 108 with legs, and punching sandbags 118 disposed on the horizontal bar 108.

To this end, the present disclosure provides the grappling apparatus 100 that serves as an "opponent" during training for wrestling. The grappling apparatus 100 fits to all individuals and allows each individual to perform exercises at their own pace. Since the grappling apparatus 100 is built using readily available materials such as PVC plumbing pipes, the grappling apparatus 100 may be light-weight and easily moved from one place to the other with minimum effort. Further, the use of PVC pipes renders the grappling apparatus 100 cost-effective and simplifies manufacturing and assembly. While being suspended from the horizontal bar 108, gravity serves as a constant resistance force on the person "P", thereby creating a setup to experience force which would be exerted by the opponent in wrestling. Since the person "P" can exercise while being suspended at the bottom of the horizontal bar 108 or on the top of the horizontal bar 108, the grappling apparatus 100 may be helpful to practice take-down-attacks and defense moves of wrestling.

Therefore the grappling apparatus described in the present disclosure helps individuals involved in wrestling and other combative sports, to improve their ability to defend against the opponent, provides a more consistent pattern of leg attacks against the opponent, allows the person training to do achieve precise defensive drills in a short period of time, helps improve strength, stamina, endurance, reaction time, speed, ability to anticipate and counter attacking skills, overcomes the necessity of training partner, and reduces the risk of injury.

DRAWINGS LEGEND

100 Grappling apparatus
102 Leg
102-1 First leg
102-2 second leg
104 vertical support member
104-1 First vertical support member
104-2 Second vertical support member
106 Foot members
106-1 First foot member
106-2 Second foot member
108 Horizontal bar
110 First end
112 Second end
114 Coupling member
114-1 First coupling member
114-2 Second coupling member
116 End caps
118 Punching bags
300 Grappling apparatus
302 Bar
304 First end
306 Second end
308 First vertical supporting member
310 Second vertical supporting member
400 Grappling apparatus
402 First horizontal bar
404 Second horizontal bar
406 Third horizontal bar
408 Fourth horizontal bar
410 Three-way connectors
412 Vertical support members
500 Grappling apparatus
502 First horizontal bar
504 Second horizontal bar
506 Cross
508 Support members
510 Circular connecting tube
512 Four-way connectors
514 Central support member
600 Grappling apparatus
602 First horizontal bar
604 Second horizontal bar
606 Third horizontal bar
608 Support members
700 Method
702 Step
704 Step
F Floor
P Person
H Height
L1 Length
L2 Length
H1 Height
H2 Height

The invention claimed is:

1. A method for training a person for wrestling, the method comprising:

grasping at least one horizontal bar of a grappling apparatus, wherein the grappling apparatus comprises:

a. a plurality of support members comprising a leg for supporting the grappling apparatus on a floor; and b. at least two horizontal bars comprising a length of about 150 cm to about 250 cm and a diameter of about 8 cm, and configured to couple with the plurality of support members, wherein the horizontal bars are located at a height of about 45 centimeters to about 70 centimeters from the floor and extend between two support members;

wherein the horizontal bars are configured to allow the person to grasp the horizontal bars with hands, body, and legs; and wherein the at least two horizontal bars are configurable to be positioned at right angles to each other and intersecting at mid-points thereof to define a cross, and wherein at least one circular connecting tube connects ends of the at least two horizontal bars, and each support member extends from one end of each of the at least two horizontal bars; and the grappling apparatus being used to perform one or more exercises while maintaining contact with at least one of the horizontal bars.

2. A method of using a grappling apparatus, the method comprising:

grasping at least one horizontal bar of a grappling apparatus, wherein the grappling apparatus comprises:

a. a plurality of support members comprising a leg for supporting the grappling apparatus on a floor; and b. at least two horizontal bars comprising a length of about 1.5 meters to about 2.5 meters, a diameter of about 8 cm, and configured to couple with the plurality of support members, wherein the at least two horizontal bars are located at a height of about 45 centimeters to about 70 centimeters from the floor and extend between two support members, the horizontal bars configured to allow a person to grasp the horizontal bars with hands, arms, body, legs, and feet;

wherein the at least two horizontal bars are configured to be positioned at right angles to each other and intersecting at mid-points thereof to define a cross, and wherein at least one circular connecting tube connects ends of the at least two horizontal bars, and each support member extends from one end of each of the at least two horizontal bars; and performing one or more exercises while maintaining contact with at least one of the horizontal bars.

3. The method (700) of claim 2, further comprising rotating the body around the horizontal bar (108) while grasping the horizontal bar (108) with hands and legs.

4. The method (700) of claim 2, further comprising suspending the upper body of the person (P) on the floor (F), grasping the horizontal bar (108) with legs, and punching sandbags (118) disposed on the horizontal bar (108).

* * * * *